United States Patent [19]

Sato et al.

[11] Patent Number: 4,955,121

[45] Date of Patent: Sep. 11, 1990

[54] METHOD FOR PRODUCING A ROCKER ARM FOR USE IN AN INTERNAL COMBUSTION ENGINE

[75] Inventors: Masakazu Sato, Tochigi; Seiichi Koike, Saitama; Toshihiro Oikawa; Keisuke Ban, both of Tochigi, all of Japan

[73] Assignee: Honda Giken Kogyo Kabushiki Kaisha, Tokyo, Japan

[21] Appl. No.: 71,652

[22] Filed: Jul. 9, 1987

[30] Foreign Application Priority Data

Jul. 9, 1986 [JP] Japan ..... 61-161737
Jul. 9, 1986 [JP] Japan ..... 61-161738

[51] Int. Cl.[5] ..... B21K 1/24

[52] U.S. Cl. ..... 29/888.2; 29/527.6; 164/98; 164/120

[58] Field of Search ..... 29/156.4 R, 156.7 B, 29/527.6; 164/98, 120, 112, 332, 105–111; 123/90.39, 90.51

[56] References Cited

U.S. PATENT DOCUMENTS

| | | | |
|---|---|---|---|
| 547,096 | 10/1895 | Taylor | 164/112 X |
| 3,106,002 | 10/1963 | Bauer | 164/120 |
| 3,204,304 | 9/1965 | Kostenko | 164/112 X |
| 3,600,238 | 8/1971 | Ravenel | 148/3 X |
| 4,121,335 | 10/1978 | Berman et al. | 164/112 X |
| 4,132,196 | 1/1979 | Wherry | 123/90.39 X |
| 4,422,229 | 12/1983 | Sadler et al. | 164/112 X |
| 4,446,907 | 5/1984 | Suzuki et al. | 164/120 |
| 4,451,974 | 6/1984 | Gellert | 164/112 X |
| 4,497,359 | 2/1985 | Suzuki et al. | 164/120 |
| 4,558,505 | 12/1985 | Moore | 164/112 X |
| 4,624,223 | 11/1986 | Wherry et al. | 29/156.7 B |
| 4,632,074 | 12/1986 | Takahashi et al. | 123/90.39 |
| 4,674,453 | 6/1987 | Dove, Jr. | 29/156.4 R X |
| 4,779,665 | 10/1988 | Ouimet | 164/120 |
| 4,779,666 | 10/1988 | Ruhlandt et al. | 164/120 |

*Primary Examiner*—Timothy V. Eley
*Assistant Examiner*—Frances Chin
*Attorney, Agent, or Firm*—Lyon & Lyon

[57] ABSTRACT

A method for casting a rocker arm made of light alloy for use in an overhead cam shaft type valve operating mechanism of an internal combustion engine, which rocker arm includes a thick-walled bearing section to be fitted on a rocker arm shaft and is integrally provided with a wear-resistive piece having a protrusion on its rear surface and adapted to abut a cam. After molten metal has been injected under pressure into a metallic mold for the rocker arm, a secondary pressurizing force directed in the direction of an imaginary center axis of a rocker arm shaft is exerted by means of a pressurizing rod. In the metallic mold for the rocker arm, a sprue is provided close to the position where the wear-resistive piece is disposed with respect to the position where the bearing section is formed, and the direction of the sprue is directed towards the position where the wear-resistive place is disposed.

2 Claims, 4 Drawing Sheets

METHOD FOR PRODUCING A ROCKER ARM FOR USE IN AN INTERNAL COMBUSTION ENGINE

BACKGROUND OF THE INVENTION

The present invention relates to a method for producing a rocker arm made of light alloy for use in an overhead cam shaft type valve operating mechanism of an internal combustion engine through a die casting process.

A rocker arm for use in an overhead cam shaft type valve operating mechanism of an internal combustion engine includes at its central portion a thick-walled cylindrical bearing section which fits on a rocker arm shaft, an abutting surface adapted to abut against a valve drive cam is formed at an end portion of one arm, and a threaded bore for mating with a valve clearance adjusting screw is formed at an end portion of the other arm. This rocker arm is normally formed of cast iron, malleable cast iron, nodular graphite cast iron, etc., and besides in recent years, it is provided also as a forged article. In order to give wear resistance to the abutting surface, in the case of a cast article the surface layer is hardened as by chill or flame hardening, and in the case of a forged article it is subjected to hardening treatment such as flame hardening, induction hardening, chromium-plating, etc. In addition, as another procedure for giving wear resistance to the abutting surface is to provide a wear-resistive piece made of sintered material, chill casting plate or the like.

On the other hand, with regard to structural member for use in an internal combustion engine, reduction in weight is being advanced positively by employment of light alloy materials such as aluminum-alloys, magnesium-alloys, etc. To form moving parts such as rocker arms of light alloy material is effective in that the inertia force is reduced. Especially it is advantageous to form rocker arms for use in an overhead cam shaft type valve operating mechanism which is preferable for a high-speed engine, of light alloy material.

FIG. 1 shows a prior art rocker arm 01 made of light alloy. This rocker arm 01 was produced through a die casting process, it includes at its central portion a thick-walled bearing section 02 in which a rocker arm shaft hole 03 adapted to fit around a rocker arm shaft is formed (it being formed by drilling a hole in a die cast article), at an end of an arm 04 is integrally joined a wear-resistive piece 05 (made of iron-series sintered material, ceramics, etc.) for abutting against a valve drive cam by cast-encircling, and at an end of an arm 06 is formed a threaded bore 07 for a variable clearance adjusting screw.

The above-mentioned bearing section 02 must be formed with a thick wall so that it can withstand large stress repeatedly applied thereto, and hence, upon casting there is a possibility that many blow holes may be produced within the bearing section.

In the case of making the rocker arm 01 shown in FIG. 1 through a die cast process, a sprue of a metal mold would be provided at a position indicated by arrow A or arrow B, and also the direction of the sprue is determined in the direction of the above-described arrow. By providing such a sprue, molten metal can be effectively fed to the bearing section 02 which requires a relatively large amount of molten metal, and to the end portion of the arm that is most remote from the sprue.

However, in the case where the sprue A is employed, since the wear-resistive piece 05 is positioned sideways with respect to the direction of feeding molten metal, feeding of molten metal to the periphery of the wear-resistive piece 05 having a protrusion is retarded, and so, a cast-encircling structure having an excellent adhesion property cannot be obtained. In the case where the sprue B is employed, since the wear-resistive piece 05 is positioned at the most remote locations from the sprue, feeding of molten metal to the periphery of the wear-resistive piece 05 is poor, and in this case also, an excellent cast-encircling structure cannot be obtained. Also, in either case, there is a possibility that displacement of the wear-resistive piece 05 may occur while pouring molten metal.

SUMMARY OF THE INVENTION

Therefore, one object of the present invention is to provide, as a sound die cast article, a rocker arm for use in an overhead cam shaft type valve operating mechanism of an internal combustion engine.

Another object of the present invention exists in that upon producing a rocker arm made of light alloy through a die casting process, a soundness of the thick-walled bearing section to be fitted on the rocker arm shaft is assured, a metallurgical structure of that bearing section is improved, and thereby it is strengthened.

Still another object of the present invention exists in that upon integrally joining a wear-resistive piece having a protrusion on its rear surface and adapted to abut against a cam with a rocker arm main body through a cast-encircling process, an excellent cast-encircling structure is obtained and displacement of the wear-resistive piece while injection of the molten metal is prevented.

In order to achieve the above-mentioned objects, according to the present invention, after molten metal has been injected under pressure into a metallic mold, just before the molten metal solidifies, a secondary pressing force in the direction of the imaginary center axis of the rocker arm is exerted upon the thick-walled bearing section by means of a pressurizing rod. With regard to an outer diameter "d" of the above-mentioned pressurizing rod, when it is chosen to be 0.17 to 0.60 times the outer diameter "D" of the above-described bearing section, a good result will be obtained. An inner diameter "d" of a rocker arm shaft hole formed by drilling in the thus obtained bearing section is preferably 6 mm or more larger than the outer diameter "d" of the above-mentioned pressurizing rod.

Also, according to the present invention, upon casting a rocker arm made of light alloy to be used in an overhead cam shaft type valve operating mechanism of an internal combustion engine, which rocker arm includes a thick-walled bearing section to be fitted on a rocker arm shaft and is integrally provided with a wear-resistive piece having a protrusion on its rear surface and adapted to abut against a cam, there is employed a metallic mold in which a sprue is provided at a position close to the position where the wear-resistive place is disposed with respect to the position where the bearing section is formed and the direction of the sprue is directed towards the position of the wear-resistive piece, and molten metal is injected under pressure towards the wear-resistive piece. According to such method of casting, a cast-encircling structure for the wear-resistive piece is improved and, while injecting the molten metal, displacement of the wear-resistive piece does not occur.

DETAILED DESCRIPTION OF THE PREFERRED EMBODIMENTS

In the following, the method according to the present invention will be described in greater detail with reference to the accompanying drawings.

Figure 1:
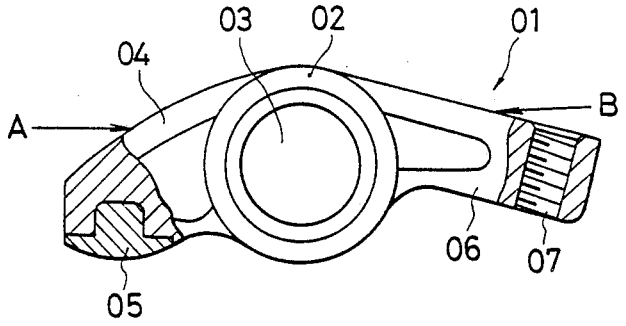
FIG. 1 PRIOR ART
FIG. 1 is a front view partly cut away of a rocker arm in the prior art.
Figure 2:
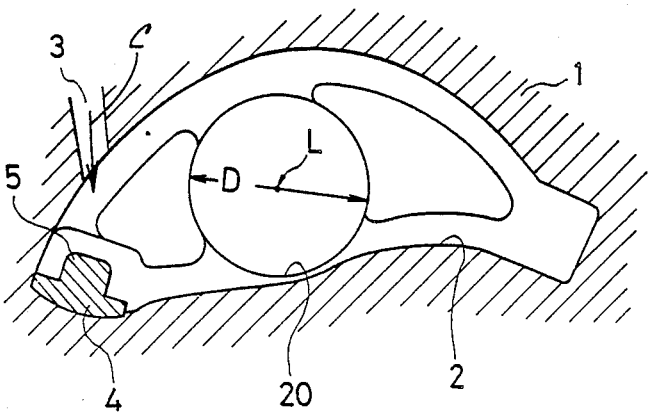
FIG. 2 is a cross-section view of an essential part of a metallic mold for a rocker arm which is to be used for practicing the present invention.

Within a mold cavity 2 for a rocker arm in a metallic mold 1 is disposed at a predetermined position a wear-resistive piece 4 (formed of iron-series sintered material, ceramics, or the like) provided with a protrusion 5 on its rear surface. A sprue 3 is formed close to the position where the wear-resistive piece 4 is disposed with respect to an imaginary center axis L of a rocker arm shaft perpendicular to the sheet of FIG. 2, and also the direction of the sprue 3 is directed towards the wear-resistive piece 4 as shown by arrow C.

By injecting molten metal towards the wear-resistive piece 4 in the above-described mold, the pressure of the molten metal can be positively utilized as an active force for stationarily fixing the wear-resistive piece 4 at the predetermined position. Further, it is possible to prevent displacement of the wear-resistive piece 4 and to improve the adhesion property between the molten metal and the wear-resistive piece 4.

Figure 3:
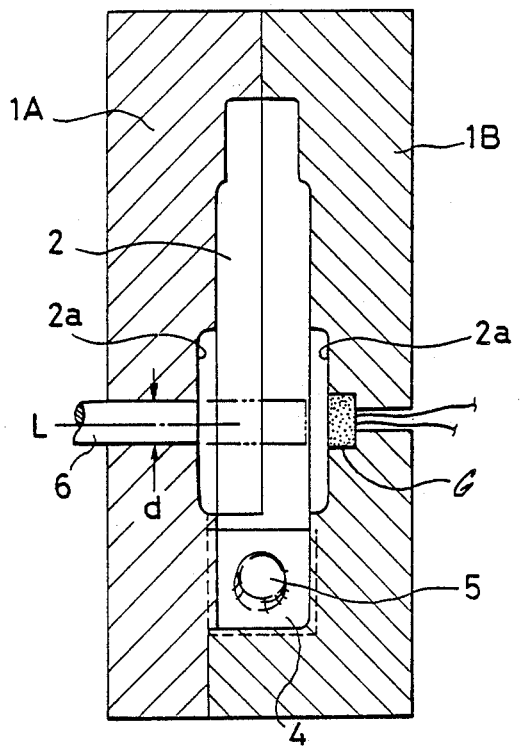
FIG. 3 is a cross-section view showing another cross-section of the same metallic mold.

In addition, between the metallic mold elements 1A and 1B, a pressurizing rod 6 that is driven by a hydraulic pressure is provided so as to advance into the cavity 2 while penetrating through one metallic mold element 1A. This pressurizing rod 6 is located on an imaginary center axis L of a rocker arm shaft, and it can be advanced and retracted along the center axis L (see FIG. 3).

If a metallic mold 1 having such a structure is employed and pressurized molten metal is injected (at 600 kg/cm$^2$), preferably aluminum alloy, into the cavity 2 through the sprue 3, then the molten metal is initially fed to the periphery of the wear-resistive piece 4, and after the peripheral portion has been filled, molten metal successively flows towards the recessed portions 2*a* where a bearing section is formed. After the cavity 2 has been completely filled with molten metal and just before the molten metal solidifies, the pressurizing rod 6 is advanced (see the double-dot chain lines in FIG. 3) to exert a secondary pressurizing force (at 2,500 Kg/cm$^2$) upon the thick-walled bearing section of the rocker arm to be produced.

The reason for secondary pressurizing of the bearing section is because blow holes are liable to be produced in the thick-walled portion where solidifcation is slower but, due to the secondary pressurizing, a uniform and micro-fine crystal structure is obtained in the peripheral region of the pressurizing rod 6, and hence greater strength is given to the bearing section which is the portion to be fitted on a rocker arm shaft.

Figure 4:
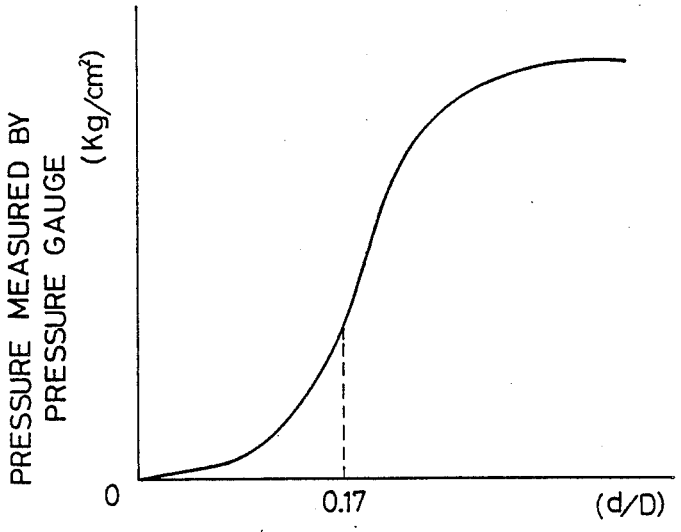
FIG. 4 is a diagram showing a relation of a pressure in molten metal versus a ratio of an outer diamter (d) of a pressurizing rod for use in secondary pressurizing to an outer diameter (D) of a bearing section of a rocker arm.

Now, the effect obtained by pushing the pressurizing rod 6 into molten metal will differ depending upon the outer diamter (d mm$\phi$) of the pressurizing rod 6, and as the outer diameter (d) is increased, a larger effect can be obtained. In order to confirm this fact, a pressure gauge G was mounted at a position in the recessed portion 2*a* of the metallic mold element lB (see FIG. 3), and when the molten metal pressure was measured while pushing pressurizing rods 6 having various different outer diameters "d" into the molten metal filled in the bearing section, a molten metal pressure curve shown in FIG. 4 was obtained (the abscissa of the graph indicating ratios (d/D) of the outer diameter "d" of the pressurizing rod 6 to an outer diameter (D mm$\phi$) of the molten metal in the bearing section).

Here, since improvement of a crystal structure by the secondary pressurizing is hardly expected for $d/D<0.17$, it is desired to select the outer diamter "d" of the pressurizing rod 6 so as to fulfill the condition of $d/D\geqq 0.17$. However, if the ratio becomes as large as $d/D>0.6$, the region influenced by pressurizing in the circumference of the pressurizing rod 6 is large, hence upon solidification, plastic deformation, cracking, etc. may arise, and such condition is not favorable.

Therefore, according to the present invention, it was specified to use a pressurizing rod 6 having an outer diameter fulfilling the condition of $d=0.17$ D to 0.60 D.

Figure 5:
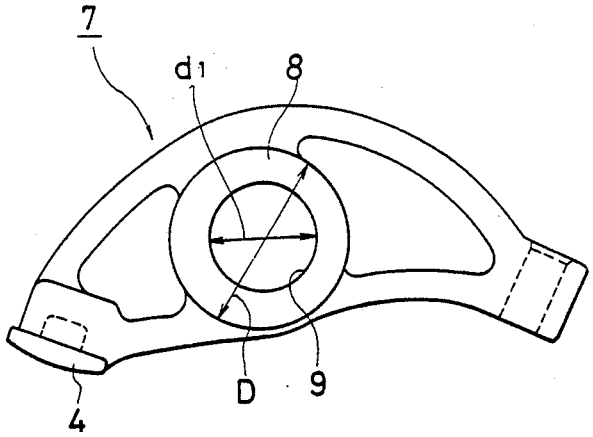
FIG. 5 is a front view showing a finished rocker arm obtained as a cast product.

Then, a hole is drilled by machining in the bearing section of the rocker arm casting and thereby a rocker arm 7 having the shape shown in FIG. 5 is obtained. It is important to properly determine the amount of machining away of material occurs in forming the rocker arm shaft hole 9 in the bearing section 8.

More particularly, since there is a tendency for abnormal structures such as crease patterns, plastic deformations, cracks, etc. to be generated in the range of a layer thickness of about 3 mm, as measured from an inner wall surface of a bottomed hole formed in the die cast article by the pressurizing rod 6, it is desirable to cut away this portion. Accordingly, it is necessary to limit the inner diameter ($d_1$ mm) of the rocker arm shaft hole 9 to $d_1\geqq d+6$ mm, and from this relation the outer diameter "d" of the pressurizing rod 6 is inversely limited to $d\leqq d_1-6$ mm.

As will be apparent from the above description, according to the present invention, since a secondary pressurizing force generated by a pressurizing rod is exerted upon a thick-walled bearing section of a rocker arm upon casting it, blow holes are minimized in the bearing section, a crystal structure therein is made uniform and micro-fine, whereby a great improvement in strength can be expected.

In addition, according to this method, when the outer diamter of the bearing section of the rocker arm is represented by D mm, the inner diameter of the rocker arm shaft hole is represented by $d_1$ mm and the diameter of the pressurizing rod is represented by d mm, the diameter of the pressurizing rod d should be determined so as to fulfill the condition of $d=0.17$ D to 0.60 D, whereby the above-described effect and advantage can be expected, soundness of the wall of the rocker arm shaft hole after the hole has been formed by drilling can be assured, and an excellent wear-resistivity can be obtained.

Furthermore, a portion having an abnormal crystal structure caused by secondary pressurizing can be removed by forming a rocker arm shaft hole in the hole portion formed by a pressurizing rod so as to fulfill the condition of $d_1 \geqq d+6$ mm.

Still further, upon casting, by injecting molten metal towards the wear-resistive piece disposed within the metallic mold, displacement of the wear-resistive piece can be prevented with the action of a pressure of the poured molten metal.

Certain tests were conducted for establishing the desired parameters, as follows:

TEST EXAMPLE 1

JIS AC12 material was employed, and this material was injected at a molten metal temperature of 670~690° C. into a metallic mold 1 under a primary pressurizing force of 600 Kg/cm$^2$.

Figure 6:
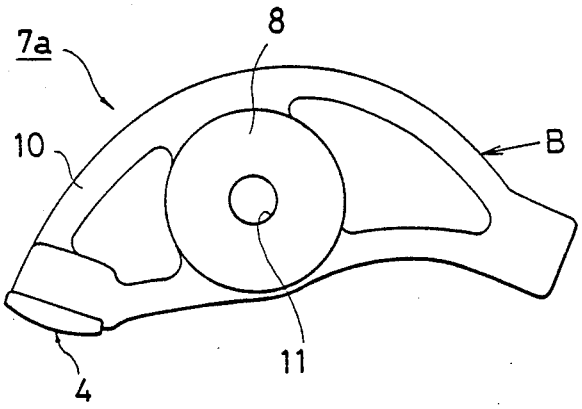
FIG. 6 is a front view of a rocker arm in an as-cast condition obtained by the illustrated metallic mold.

The as-cast rocker arm 7*a* (see FIG. 6) was cut along a plane perpendicular to an imaginary center axis L of the rocker arm shaft, and when a gap space at S between a main body 10 and a wear-resistive piece 4 was investigated for the purpose of checking a tight adhesion property therebetween, it was found that the gap length was 20 μm at the maximum. Whereas, when a gap space was investigated in a similar manner with respect to an as-cast rocker arm which was cast with the sprue of the metallic mold disposed at the postion indicated by arrow B in FIG. 6, it was found that the gap length was 40 μm at the maximum.

TEST EXAMPLE 2

JIS AC12 material was employed, and this material was injected at a molten metal temperature of 670~690° C. into a metallic mold 1 under a primary pressurizing force of 600 Kg/cm$^2$.

Then, a pressurizing rod 6 was advanced just before the bearing section solidified, and thereby a secondary pressurizing force of 2,500 Kg/cm$^2$ was exerted upon the thick-walled bearing section of the rocker arm to be produced.

Figure 7:
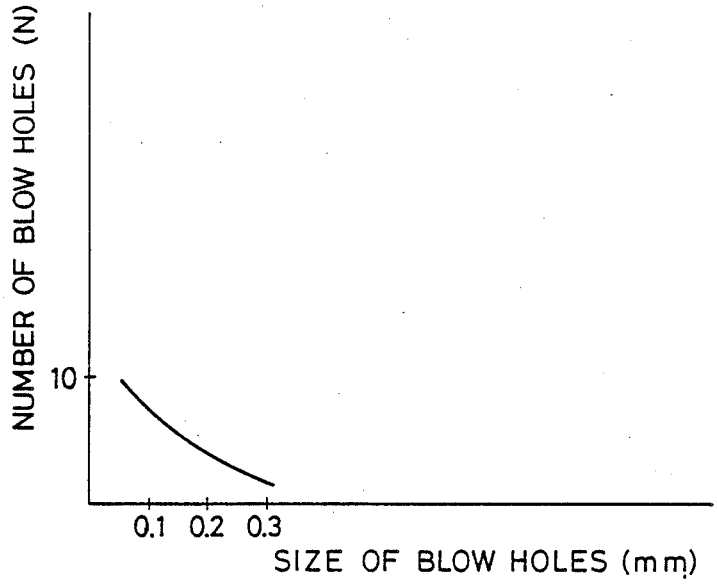
FIG. 7 is a diagram showing distribution of blow holes of different sizes in the rocker arm formed by the method according to the present invention.

The as-cast rocker arm 7*a* (see FIG. 6, although the same figure is referred to in common to Test Example 1) was cut along a plane perpendicular to an imaginary center axis L of a rocker arm shaft, then etching of a bearing section 8 having the plunger hole 11 was carried out and sizes of blow holes as well as number "N" of blow holes having respective sizes were investigated. The results of investigation are shown in FIG. 7.

TEST EXAMPLE 3

Figure 8:
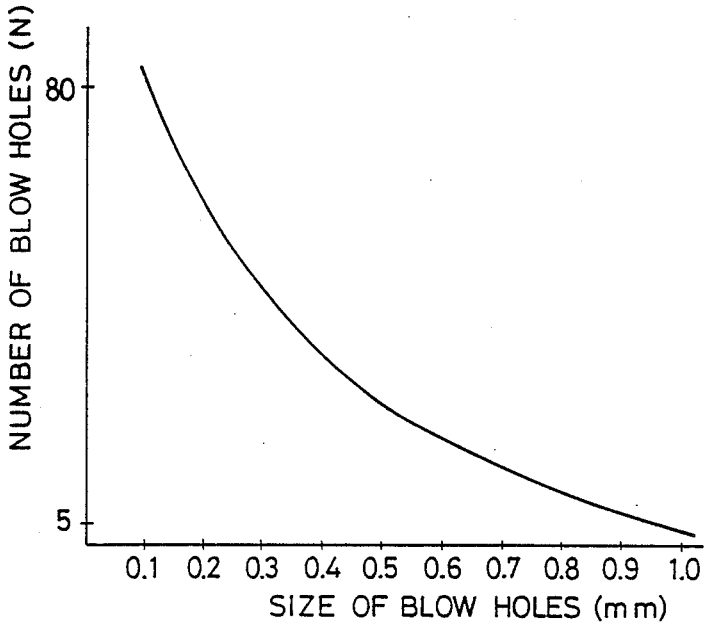
FIG. 8 is a diagram showing, as a contrast, distribution of blow holes of different sizes in a rocker arm in a manner not practicing the present invention.

Casting of a rocker arm was carried out under the same conditions as Test Example 2 above except for the fact that the secondary pressurizing was not effected. The as-cast rocker arm was investigated in the same manner for sizes of blow holes as well as numbers (N) of blow holes having respective sizes. The results of investigation are shown in FIG. 8.

EVALUATION OF THE TEST RESULTS

It is obvious that both the numbers of generated blow holes and the sizes of the blow holes are greatly reduced by the secondary pressurizing, and it is seen that a rocker arm of excellent quality having no significant defects can be obtained thereby.

Also, it is seen that the cast encircling property for a wear-resistive piece is improved by disposing the sprue of the metallic mold at a position close to the wear-resistive piece and by injecting molten metal towards that wear-resistive piece.

What is claimed is:

1. A method for producing a rocker made of light alloy for use in an overhead cam shaft type valve operating mechanism of an internal combustion engine, which rocker arm includes a thick-walled bearing section elongated along an axis to contain a rocker arm shaft hole for fitting with a rocker arm shaft, comprising the steps of:

injecting molten metal under pressure into a cavity of a metallic mold for casting the rocker arm, exerting a secondary pressurizing force upon said bearing section just before the molten metal solidifies by advancing a pressurizing rod into said cavity to form a hole in said bearing section during casting substantially concentric with a locus for the rocker arm shaft hole by displacing molten metal in said cavity in a radial direction from said pressurizing rod, said pressurizing rod having an outer diameter $d=0.17$ D to 0.60 D, wherein D equals an outer diameter of the bearing section and d is smaller than the rocker arm shaft diameter, and machine finishing said rocker arm shaft hole after casting.

2. A method for producing a rocker arm as claimed in claim 1, wherein a rocker arm shaft hole having an inner diameter $d_1 \geqq d+6$ mm is formed in the bearing section after casting by drilling.

* * * * *